US006983684B2

(12) United States Patent
Husted

(10) Patent No.: US 6,983,684 B2
(45) Date of Patent: Jan. 10, 2006

(54) MODIFIED HIGH-TEMPERATURE PRESSING APPARATUS

(75) Inventor: Stephen Husted, Baldwin, GA (US)

(73) Assignee: Huber Engineered Woods LLC, Charlotte, NC (US)

( * ) Notice: Subject to any disclaimer, the term of this patent is extended or adjusted under 35 U.S.C. 154(b) by 0 days.

(21) Appl. No.: 10/054,131

(22) Filed: Jan. 22, 2002

(65) Prior Publication Data

US 2003/0136280 A1 Jul. 24, 2003

(51) Int. Cl.
*B30B 15/34* (2006.01)

(52) U.S. Cl. ..... 100/92; 100/308; 100/319; 156/583.1

(58) Field of Classification Search ..... 100/92, 100/193, 194, 195, 196, 198, 38, 306, 302, 100/307, 308, 315, 319, 305; 156/583.1, 156/580, 359; 425/406, 407
See application file for complete search history.

(56) References Cited

U.S. PATENT DOCUMENTS 2,432,215 A * 12/1947 Stocker ..... 425/143
2,646,105 A * 7/1953 Langer ..... 100/326
3,050,777 A 8/1962 Siempelkamp
3,517,610 A 6/1970 Siempelkamp
3,785,279 A * 1/1974 Fails ..... 100/319
3,960,069 A * 6/1976 Bowyer ..... 100/38
4,365,547 A * 12/1982 McClure, Jr. ..... 100/38
4,412,801 A * 11/1983 Pesch ..... 425/338
5,167,750 A * 12/1992 Myers ..... 156/583.9
5,435,883 A * 7/1995 Myers ..... 156/583.9
5,810,965 A * 9/1998 Fwu ..... 156/359
6,209,451 B1 * 4/2001 Van Haag et al. ..... 100/327
6,668,714 B2 * 12/2003 Wollny et al. ..... 100/324

FOREIGN PATENT DOCUMENTS

JP 40-2070406 A * 3/1990

OTHER PUBLICATIONS

Translation copy of JP-40-2070406 A—Mar. 1990—Japan—Eguchi et al. (19 pages).*

* cited by examiner

*Primary Examiner*—Derris H. Banks
*Assistant Examiner*—Jimmy Nguyen
(74) *Attorney, Agent, or Firm*—Carlos Nieves; David Mitchell Goodrich; William Parks

(57) ABSTRACT

A high-temperature pressing apparatus silica is provided for the manufacture of wood composite boards, in which the temperature of the platens in the pressing apparatus can be effectively regulated to improve energy efficiency, reducing press cycle length, and minimize the possibly of press fires. The apparatus comprises a press having platens for forming the board; and a means for regulating the temperature of the platens. The regulating means includes means for circulating a heating fluid through the platens, means for detecting the temperature of the heating fluids as it exits the platens; and means for responding to the detected temperature for heating the fluid supplied to the platens.

2 Claims, 3 Drawing Sheets

MODIFIED HIGH-TEMPERATURE PRESSING APPARATUS

BACKGROUND OF THE INVENTION

Pressed boards and wood composite materials are manufactured from mixtures of wood and one or more additives, such as adhesives and waxes. During manufacture, the wood-additive mixture is first laid down in batches on a conveyor belt in a loose mat, and this loose mat is then simultaneously compressed and heated. Heating the mat cures the binder and waxes present in the mixture wood-additive mixture as well as evaporates the moisture present in the raw materials, while by compressing the wood and additive materials are fused together to form a consolidated wood board.

Compression of the wood-additive may occur in a multi-platen press where several mat batches are set upon a series of press platens, and the batches compressed between adjoining platens. The platens are heated to high temperatures by passing a heating fluid through them and this heat in the platens is then dissipated as heat flows from the platens and into the mats while the mats are being compressed (the platens acting essentially as heat exchangers). As the platens dissipate or exchange heat into the wood mats, however, the temperature of the platens decreases, which is undesirable because at lower temperatures the binders and waxes in the wood-additive mixtures are slower to cure and thus require longer curing times. This temperature drop often occurs early in the pressing cycle, when the moisture content of the wood is highest, and is thus particular undesirable because wood is a poor conductor of heat, and high moisture concentrations are necessary to transfer heat into the interior of the wood-additive mat mixture.

Previously, in order to prevent this temperature loss during the pressing cycle, the press was maintained at a temperature higher than necessary so that as the temperature fell during compression, the temperature remained sufficiently high to promote the curing of the binder and the production of a solid wood composite product. The temperature of the platens is regulated and monitored by measuring the temperature of the oil that is supplied to the press at the inlet.

While this over-compensation technique may prevent the deleterious temperature drop that could impair the curing rate, it also has disadvantages. In particular, maintaining the press platens at these high temperatures has been noted to increase the incidence of press fires, particularly after long periods of downtime. Moreover, because the temperature cannot be accurately controlled, the press cycle is lengthened so as to ensure that sufficient heat is transferred to the batches of the wood-additive mixture to complete the curing and fusing processes. Furthermore, this over compensation technique is not an efficient use of energy.

Given the foregoing there is a continuing need for an apparatus and method for producing pressed boards and composite wood products whereby the temperature of the press platens can be effectively regulated so that the press cycle length is shortened, the possibility of press fires minimized, and the press operated under energy-efficient conditions.

BRIEF SUMMARY OF THE INVENTION

The invention includes an apparatus for the production of wood composite boards, comprising a press having platens for forming the board; and a means for regulating the temperature of the platens. The regulating means includes means for circulating a heating fluid through the platens, means for detecting the temperature of the heating fluids as it exits the platens; and means for responding to the detected temperature for heating the fluid supplied to the platens.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

All parts, percentages and ratios used herein are expressed by weight unless otherwise specified. All documents cited herein are incorporated by reference.

As used herein, "wood" is intended to mean a cellular structure, having cell walls composed of cellulose and hemicellulose fibers bonded together by lignin polymer.

By "wood composite material" it is meant a composite material that comprises wood and one or more other additives, such as adhesives or waxes. The wood is typically in the form of veneers, flakes, strands, wafers, particles, and chips. Non-limiting examples of wood composite materials include oriented strand board ("OSB"), waferboard, particle board, chipboard, medium-density fiberboard, plywood, and boards that are a composite of strands and ply veneers. As used herein, "flakes", "strands", "chips", "particles", and "wafers" are considered equivalent to one another and are used interchangeably. A non-exclusive description of wood composite materials may be found in the Supplement Volume to the Kirk-Rothmer Encyclopedia of Chemical Technology, pp 765–810, $6^{th}$ Edition.

The present invention is directed to a press installation constructed to regulate the temperature of the press, and specifically the temperature of the press platens contained inside the press. The temperature of these platens (which compress the wood-additive mixtures into pressed boards or other composite products) is regulated by controlling the temperature of the oil supplied to the press platens. By changing the blend of cooler and warmer oil that is supplied to the press, the temperature of the platens can be regulated to within a relatively fine degree of tolerance.

Figure 1:
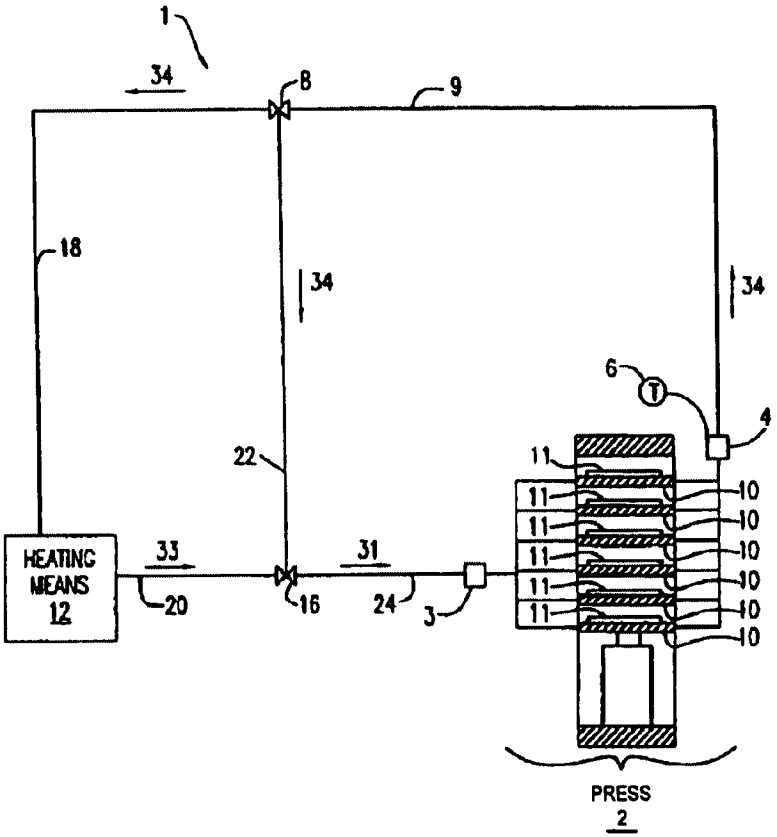
FIG. 1 is a schematic diagram showing the arrangement of a pressing apparatus prepared according to a preferred embodiment of the present invention.

Referring now to FIG. 1, a preferred embodiment of a press installation is shown including a press 2, a heating fluid temperature monitor 6 (specifically, the outlet temperature monitor), which measures the temperature of the heating fluid in the heating fluid outlet 4.

The press 2 can be a multi-platen press in which a head plate is mounted above a bed plate, which can be raised and lowered by conventional hydraulic equipment capable of generating the required pressures. Between the head plate and bed plate are multiple press platens that are positioned adjacent to and equally-spaced relative to each other and are operated by an automatic opening and closing mechanism and device. Typically, a mat of wood material (e.g., wood flakes, particles or chips) is brought to the press on a conveyor system and loaded into a prepress. These mats are made from one or more layers of wood flakes, particles or chips that are coated with additives like resin binder or wax. From the prepress, the mats are charged into the hydraulic press onto press platens where the mats are compressed to produce sheets of a wood composite material or wood boards, and then loaded into a discharge apparatus for emptying the sheets formed on the platens.

Each of these platens can be heated by passing, through the aid of pumping means, a heating fluid through the platen, such as through a series of conduits and channels that are constructed within the plate. The heating fluid may be selected from the group consisting of natural gas, superheated steam, and oil. Electrical-resistive heating equipment may also be used. Multi-platen presses are discussed in greater detail in U.S. Pat. No. 4,412,801, issued to Pesch, on Nov. 1, 1983. A heated multi-platen press is discussed in greater detail in U.S. Pat. No. 3,251,169, issued to Siempelkamp, on Jun. 29, 1961.

Instead of the multi-platen press discussed above, a continuous press may be used. In this type of press a mat formed of wood material and adhesive is continuously fed between two platens on press belts passing around rollers. In such an embodiment, a mat of wood flakes progresses on a conveyor through the continuous press to produce a continuous sheet of a wood composite material. The platens may be heated in the same manner as described above for the multi-platen press.

In the present press installation the heating fluid is heated by a heating means 12, such as a furnace. In one embodiment, the heating fluid is heated in a heat exchanger. In this heat exchanger, wood dryers (which heat the wood material to remove the moisture) are the source of the heat. By configuring heating fluid-carrying tubing around and in proximity to the wood dryers, the heat given off the by the dryers may enter the heating fluid to heat it. Suitable heating fluid for use in the present invention includes natural gas, heated oil, and superheated steam.

The operation of the press installation prepared according to the present invention and shown in FIG. 1 will now be described.

A means for regulating the temperature of the platens in the press 2 is shown in FIG. 1 as freshly-heated heating fluid 33 passes under pressure from a heating means 12 through a first passage 20 and through a blend valve 16 where it is mixed with recirculated heating fluid 34 to form press heating fluid 31 (the operation of the blend valve is described in more detail below), the press heating fluid 31 then flows into a second passage 24 and then into an inlet 3 into the press 2. The aforementioned passages and valves constitute a means for circulating a heating fluid through the platens 10 in the press 2. The temperature of the oil in the inlet may be measured by an inlet temperature monitor (not shown). Once inside the press 2 the fluid is distributed and carried by various channels and conduits located in each of the platens 10 in order to heat the platens 10. The wood-additive mats 11 are then loaded onto each of the platens 10 and compressed (in a multi-platen press) or a mat of the wood-additive mixtures is forced through two heated platens 10 to form a continuous sheet of material (in a continuous press). The heat supplied to the platens 10 by the heating fluid is dissipated into the batches of wood-additives 11 being formed into pressed board or other wood composite products, thus the press platens 10 functions essentially as heat exchangers-transferring heat from the heating fluid into the batches of the wood-additive mixture. This causes a decrease in the temperature of the press platens 10 and heating fluid.

After traveling through the press platens 10 the heating fluid exits the platens 10 through the outlet 4 and the temperature of the heating fluid is monitored by a means for detecting the temperature of the heating fluid as it exits the platens 10, this means for detecting the temperature may be a temperature monitor, such as an outlet temperature monitor 6. (The temperature measured in the outlet 4 should generally be less than the temperature measured in the inlet because the heating fluid in the outlet has exchanged some of its heat with the press platens.) Because the recirculating heating fluid 34 has contacted and exchanged heat with the press platens 10, it has established a metastable thermal equilibrium with the press platens 10, and then flows directly from the press platens 10 into the outlet, where its temperature is measured by the outlet temperature monitor 6, and is thus a very accurate measure of the actual temperature of the press platens 10. The location of the outlet temperature monitor 6 downstream of the outlet 4 has not previously been discovered in the prior art, which relies on temperature sensors measuring the temperature of the heating fluid flowing into a press.

Subsequently, the recirculating heating fluid 34 flows from the outlet 4 and is recycled by being passed through a third passage 9 and through the recirculating valve 8. From the recirculating valve 8 the recirculating heating fluid 34 may be carried back through the return passage 18 to the heating means 12, where the heating fluid may be subjected to additional heating to bring it to the temperature of freshly-heated heating fluid 33. Alternatively, the heating fluid may be directed by the recirculating valve 8 into the bypass passage 22 to flow to the first valve 16.

The present invention also includes a means for responding to the detected temperature for heating the fluid supplied to the platens 10. In operation, the blend valve 16 controls the temperature of the press heating fluid 31 that flows through the second passage 24 and into the press platens 10 inside the press 2. The press heating fluid 31 passing through the second passage 24 is a blend of the recirculating heating fluid 34 entering the blend valve 16 from the bypass passage 22 and the freshly heated fluid 33 entering the blend valve 16 from the first passage 20. The blend valve 16 regulates the relative proportions of the freshly heated fluid 33 and the recirculating fluid 34 that are blended in the blend valve to form the press heating fluid 31. The recirculating heating fluid 34 is generally colder than the freshly heated fluid 33, because it has passed through the press 2, and thus dissipated some of its heat into the press platens.

Higher press heating fluid 32 temperatures in the second passage 24 may be obtained by actuating the value 16 to reduce the proportion of the recirculating fluid 32 that is blended with the freshly-heated heating fluid 33 to form the press heating fluid 32. Similarly, lower press heating fluid 32 temperatures in the second passage 24 may be obtained by actuating the valve 16 to increase the proportion of the recirculating fluid 32 relative to the proportion of freshly-heated heating fluid 33 in the press heating fluid 31.

Figure 2:
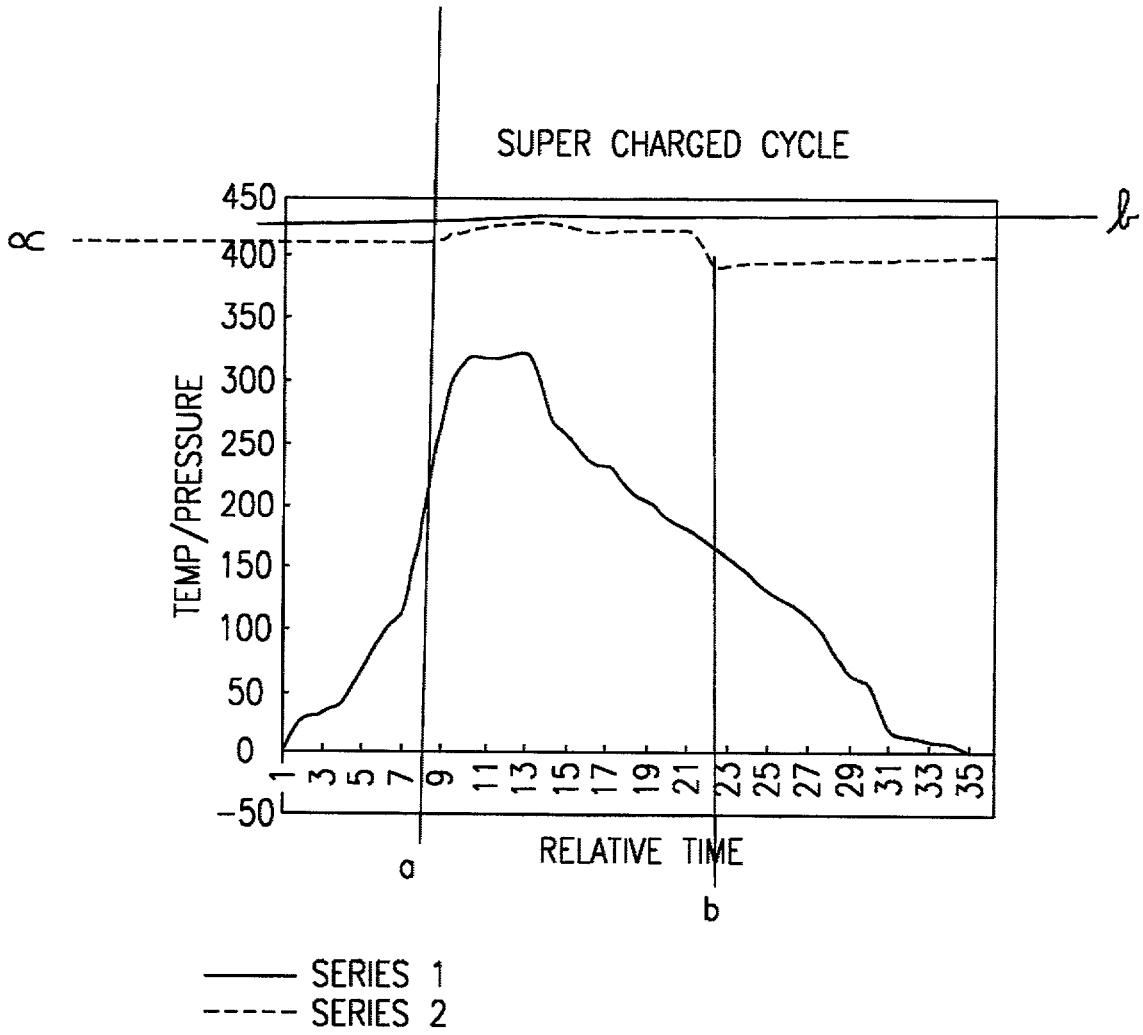
FIG. 2 is a plot of compression and temperature against time. The time is relative to the beginning of the pressing cycle. Both compression and temperature are plotted on the same figure, with the compression corresponding to the bottom curve, and the temperature corresponding to the top curve.

Accordingly, by regulating the temperature of the press heating fluid 31 in the second passage 24, the temperature of the press platens 10 may be controlled during the operation of the press 2. FIG. 2 is a chart of the temperature and pressure at which the press is operated through the completion of one normal press cycle. Before the beginning of the compression cycle at relative time=1 second, the press platens are brought to an initial temperature, designated as by alpha in FIG. 2. The press cycle then begins at relative time=1 second, as compression of the wood mat in the press platens begins, and continues until relative time=35 seconds, when compression returns to zero as the press platens separate. At time "a" (shown for illustration purposes in FIG. 2 at approximately relative time=8 seconds) a few seconds after the compression cycle begins, but before the maximum pressure is reached, the platens are heated to temperature beta (the mechanisms for heating the press platens is described in detail above).

Thus, in the apparatus of the present invention is operated so that temperature of the press platens increases during the course of the pressing cycle while at the same time, the compression pressure is increasing to its maximum value. This is in contrast to prior art heated press machines where the temperature of the press platens is highest just before the press cycle begins, and gradually decreases through the press cycle as heat is dissipated (or exchanged) from the press heating fluid 31 into the wood mat. The high press platen temperature increases the cure rate at the same time that the high compression pressure supplied by the press platens forces the strands, particles or veneers in the mats that comprise the wood mat closer together to enhance the inter-fiber bonding. The result is composite wood boards and materials mats that are not only stronger, but that can be processed more quickly.

As is clear from the foregoing, the temperature of the various heating fluids, and ultimately the press 2 and press platens 10 is regulated by the action of the blend valve 16 and the recirculating valve 8, which control the proportions at which the recirculated heating fluid 34 and the freshly heated heating fluid 33 are blended to form the press heating fluid 31. Various means are available for adjusting the blending valve 16 and controlling the recirculating valve 8. During operation of the press, a signal generated by the outlet temperature sensor 6 and indicative of the recirculating oil temperature is transmitted to an input/output device, such as a computer or other display terminal. A human operator watches the signal from the outlet temperature sensor and controls the action of the valves 8, 16, so that the press platens 10 are maintained at the desired temperature. The input/output device (not shown) may also be programmed to record and store the signal data generated by the outlet temperature sensor.

Alternatively, the actuation of the valves may be automated. For example, a signal generated by the outlet temperature sensor 6 and indicative of the recirculating heating fluid 34 temperature is transmitted to an automated control device (not shown). The automated control device determines whether the recirculating oil temperature deviates from a desired set point, and if there is such a deviation, the blend valve 16 can be actuated by the automated control device to reduce the deviation from the desired set point.

The operation of the press may also be preprogrammed. In this technique, first a series of test runs are made for a specific set of operating parameters. These operating parameters include not only the specifications of the press cycle itself such as compression rate, and the desired operating press platen temperature, but also include the characteristics of the wood boards, such as the intended thickness, strand morphology, and the binder and wax composition. After the series of test runs for the set of operating parameters is completed, a profile is obtained. This profile, which may resemble FIG. 2, shows the temperature of the recirculating heating fluid as a function of time during the pressing cycle. As discussed above, the temperature of the press platens is taken to be the same as the temperature of the recirculating heating fluid 34.

By examining the profile, an operator of ordinary skill can determine at what time in the pressing cycle the temperature of the press platens drops. Then, in advance of the pressing cycle, the operators programs an automated control device to actuate the blending valve 16 to increase the proportion of freshly-heated heating fluid 33 in the press heating fluid 31 blend that is supplied to the press so as to increase the temperature of the press platens. This means that extra heat will be present in the press heating fluid 31 to counter the expected drop in temperature caused by the dissipation of heat from the press platens and into the mats during the pressing cycle.

Figure 3:
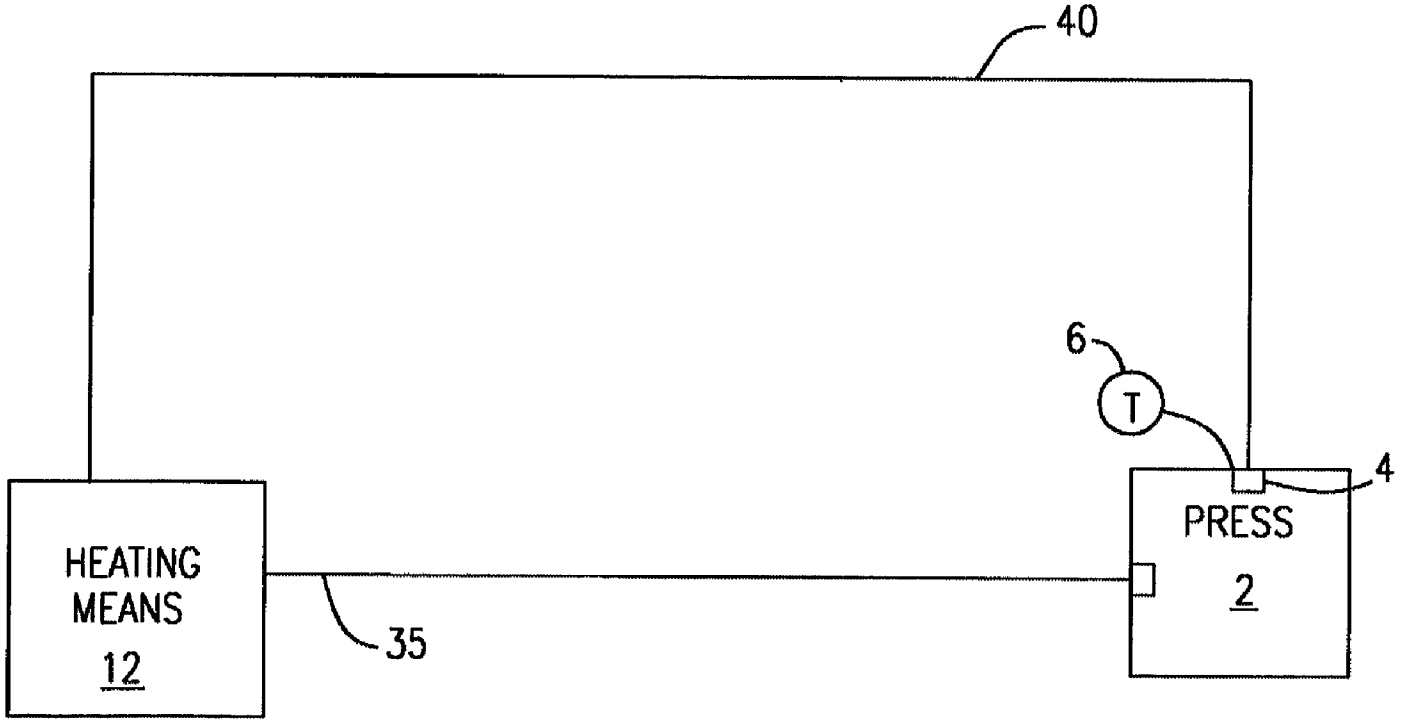
FIG. 3 is a schematic diagram showing the arrangement of a pressing apparatus prepared according to the present invention.

Referring now to FIG. 3, a more general illustration of a press installation prepared according to the present invention is shown. The installation includes a press 2, a heating fluid temperature monitor 6 (specifically, the outlet temperature monitor), which measures the temperature of the heating fluid in the heating fluid outlet 4. The embodiment comprises a means for circulating a heating fluid through the platens, which is shown as freshly heated fluid travels under pressure from a heating means 12 through a passage 35 and then into the press 2. Once inside the press 2, the fluid is distributed as described above to heat the wood-additive mats. After traveling through the press platens, the heating fluid is recycled by being passed through the outlet 4 and through a detecting the temperature of the heating fluids, represented in FIG. 3 by an outlet temperature monitor 6. The heating fluid then flows through the return passage 40 to the heating means 12. The heating means 12 also serves as the means for responding to the detected temperature for heating the heating fluid: in operation, the heating means 12 controls the temperature of the heating fluid that flows through the passage 35. Higher heating fluid temperatures in the passage 35 may be obtained by supplying extra heat to the heating fluid circulating through the heating means 12. Thus, when the outlet temperature monitor 6 indicates that the temperature of the heating fluid must be increased, the heating means 12 provides additional heat to the heating fluid to raise the temperature of the heating fluid.

The panels prepared according to the present invention may be made from a variety of different materials, such as wood or wood composite materials, such as oriented strand board ("OSB"). OSB panels are derived from a starting material that is naturally occurring hard or soft woods, singularly or mixed, whether such wood is dry (having a moisture content of between 2 wt % and 12 wt %) or green (having a moisture content of between 30 wt % and 200 wt %). Typically, the raw wood starting materials, either virgin or reclaimed, are cut into strands, wafers or flakes of desired size and shape, which are well known to one of ordinary skill in the art.

After the strands are cut they are dried in an oven to a moisture content of about 2 wt % to 5 wt % and then coated with one or more polymeric thermosetting binder resins, waxes and other additives. The binder resin and the other various additives that are applied to the wood materials are referred to herein as a coating, even though the binder and additives may be in the form of small particles, such as atomized particles or solid particles, which do not form a continuous coating upon the wood material. Conventionally, the binder, wax and any other additives are applied to the wood materials by one or more spraying, blending or mixing techniques, a preferred technique is to spray the wax, resin and other additives upon the wood strands as the strands are tumbled in a drum blender.

After being coated and treated with the desired coating and treatment chemicals, these coated strands are used to form a multi-layered mat. In a conventional process for forming a multi-layered mat, the coated wood materials are spread on a conveyor belt in a series of two or more, preferably three layers. The strands are positioned on the conveyor belt as alternating layers where the "strands" in adjacent layers are oriented generally perpendicular to each other.

Various polymeric resins, preferably thermosetting resins, may be employed as binders for the wood flakes or strands. Suitable polymeric binders include isocyanate resin, urea-formaldehyde, phenol formaldehyde, melamine formaldehyde ("MUF") and the co-polymers thereof. Isocyanates are the preferred binders, and preferably the isocyanates are selected from the diphenylmethane-p,p'-diisocyanate group of polymers, which have NCO- functional groups that can react with other organic groups to form polymer groups such as polyurea, —NCON—, and polyurethane, —NCOON—. 4,4-diphenyl-methane diisocyanate ("MDI") is preferred. A suitable commercial MDI product is Rubinate pMDI available from ICI Chemicals Polyurethane Group. Suitable commercial MUF binders are the LS 2358 and LS 2250 products from the Dynea corporation.

The binder concentration is preferably in the range of about 1.5 wt % to about 20 wt %, more preferably about 3 wt % to about 10 wt %. A wax additive is commonly employed to enhance the resistance of the OSB panels to moisture penetration. Preferred waxes are slack wax or an emulsion wax. The wax loading level is preferably in the range of about 0.5 to about 2.5 wt %.

After the multi-layered mats are formed according to the process discussed above, they are compressed under a hot press machine that fuses and binds together the wood materials to form consolidated OSB panels of various thickness and sizes. Preferably, the panels of the invention are pressed for 2–10 minutes at a temperature of about 175° C. to about 240° C. The resulting composite panels will have a density in the range of about 35 to about 50 pcf (as measured by ASTM standard D1037-98) and a thickness of about 0.6 cm (about It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An apparatus for the production of wood composite boards, comprising:

(a) a press having platens for forming the board;

(b) a heating means comprising a heat exchanger; and (c) means for regulating the temperature of the platens, the regulating means including:

(i) means for circulating a heating fluid through the heating means and the platens, (ii) means for detecting the temperature of the heating fluid as it exits the platens; and (iii) means for responding to the detected temperature for heating the fluid supplied to the platens; wherein the heating fluid is selected from the group consisting of heated natural gas, superheated steam, and heated oil.

2. The apparatus according to claim 1, wherein the press is selected from the group consisting of multi-platen press and continuous press.

* * * * *